United States Patent [19]

Tanner et al.

[11] 4,148,669

[45] Apr. 10, 1979

[54] ZIRCONIUM-TITANIUM ALLOYS CONTAINING TRANSITION METAL ELEMENTS

[75] Inventors: Lee E. Tanner, Summit; Ranjan Ray, Morristown, both of N.J.

[73] Assignee: Allied Chemical Corporation, Morris Township, Morris County, N.J.

[21] Appl. No.: 892,618

[22] Filed: Apr. 3, 1978

Related U.S. Application Data

[62] Division of Ser. No. 823,056, Aug. 9, 1977, Pat. No. 4,126,449.

[51] Int. Cl.[2] ..... C21D 1/00; C22F 1/00

[52] U.S. Cl. ..... 148/3; 148/13; 148/13.2

[58] Field of Search ..... 75/164, 122, 139 F, 75/139 N, 139 C, 123 H, 123 M, 139, 175.5, 170, 177; 148/4, 134, 13, 13.2

[56] References Cited

U.S. PATENT DOCUMENTS

| | | | |
|---|---|---|---|
| 3,660,082 | 5/1972 | Negishi et al. | 75/134 F |
| 3,856,513 | 12/1974 | Chen et al. | 75/170 |
| 3,862,658 | 1/1975 | Bedell | 164/87 |

FOREIGN PATENT DOCUMENTS

| | | | |
|---|---|---|---|
| 1084030 | 6/1960 | Fed. Rep. of Germany | 75/171 |

OTHER PUBLICATIONS

Ray et al., "New Non-Crystalline Phases in Splat Cooled Transition Metal Alloys," Scripla Metallurgica, pp. 357-359, (1968).

Poleysa et al., "Formation of Amorphous Phases and Metastable Solid Solutions in Binary Ti and Zr Alloys with Fe,Ni,Cu." Izvestia AK. Nauk. SSSR Metals, pp. 173-178, (1973).

Varieh et al., "Metastable Phases in Binary Ni Alloys Crystallized During Very Rapid Cooling," Physics of Metals and Metallography, No. 2, vol. 33, pp. 335-338, 1972.

Ray et al., "The Constitution of Metastable Ti-Rich Ti-Fe Alloys:An Order-Disorder Transition," Metall Trans., vol. 3, pp. 627-629, (1972).

*Primary Examiner*—Arthur J. Steiner

*Attorney, Agent, or Firm*—Ernest D. Buff; Gerhard H. Fuchs

[57] ABSTRACT

Zirconium-titanium alloys containing at least one of the transition metal elements of iron, cobalt, nickel and copper are disclosed. The alloys consist essentially of about 1 to 64 atom percent titanium plus at least one element selected from the group consisting of about 15 to 27 atom percent iron, about 15 to 43 atom percent cobalt, about 15 to 42 atom percent nickel and about 35 to 68 atom percent copper, balance essentially zirconium plus incidental impurities, with the proviso that when iron is present, the maximum amount of titanium is about 25 atom percent, when cobalt is present, the maximum amount of titanium is about 54 atom percent and when nickel is present, the maximum amount of titanium is about 60 atom percent. The alloys in polycrystalline form are capable of being melted and rapidly quenched to the glassy state. Substantially totally glassy alloys of the invention evidence unusually high electrical resistivities of over 200 $\mu\Omega$-cm.

3 Claims, 4 Drawing Figures

ZIRCONIUM-TITANIUM ALLOYS CONTAINING TRANSITION METAL ELEMENTS

This is a division of application Ser. No. 823,056, filed Aug. 9, 1977, now U.S. Pat. No. 4,126,449.

BACKGROUND OF THE INVENTION

1. Field of the Invention

This invention relates to zirconium-base alloys, and, in particular, to zirconium-titanium alloys containing transition metal elements.

2. Description of the Prior Art

Materials having high electrical resistivity (over 200 $\mu\Omega$-cm) and negative or zero temperature coefficients of resistivity are required for precision resistors, resistance thermometers and the like. High resistivity materials permit fabrication of smaller resistors. Negative temperature coefficients of resistivity provide larger resistance values at lower temperatures, thus increasing the sensitivity of low temperature resistance thermometers. Zero temperature coefficients of resistivity provide stability of resistance with temperature, which is required for useful precision resistors. Commonly available alloys such as Constantan (49 $\mu\Omega$-cm) and Nichrome (100 $\mu\Omega$-cm) are examples of materials generally employed in these applications.

A number of splat-quenched foils of binary alloys of zirconium and titanium with transition metal elements such as nickel, copper, cobalt and iron have been disclosed elsewhere; see, e.g., Vol. 4, *Metallurgical Transactions,* pp. 1785–1790 (1973) (binary Zr-Ni alloys); *Izvestia Akadameya Nauk SSSR, Metals,* pp. 173–178 (1973) (binary Ti or Zr alloys with Fe, Ni or Cu); and Vol. 2, *Scripta Metallurgica,* pp. 357–359 (1968) (binary Zr-Ni, Zr-Cu, Zr-Co and Ti-Cu alloys). While metastable, noncrystalline single phase alloys are described in these references, no useful properties of these materials are disclosed or suggested.

SUMMARY OF THE INVENTION

In accordance with the invention, zirconium-titanium alloys which additionally contain transition metal elements are provided. The alloys consist essentially of about 1 to 64 atom percent titanium plus at least one element selected from the group consisting of about 15 to 27 atom percent iron, about 15 to 43 atom percent cobalt, about 15 to 42 atom percent nickel and about 35 to 68 atom percent copper, balance essentially zirconium plus incidental impurities, with the proviso that when iron is present, the maximum amount of titanium is about 25 atom percent, when cobalt is present, the maximum amount of titanium is about 54 atom percent and when nickel is present, the maximum amount of titanium is about 60 atom percent.

The alloys in polycrystalline form are capable of being melted and rapidly quenched to the glassy state in the form of ductile filaments. Further, such glassy alloys may be heat treated, if desired, to form a polycrystalline phase which remains ductile. Such polycrystalline phases are useful in promoting die life when stamping of complex shapes from ribbon, foil and the like is contemplated.

Substantially glassy alloys of the invention possess useful electrical properties, with resistivities of over 200 $\mu\Omega$-cm, moderate densities and moderately high crystallization temperatures and hardness values.

DETAILED DESCRIPTION OF THE INVENTION

Figure 1:
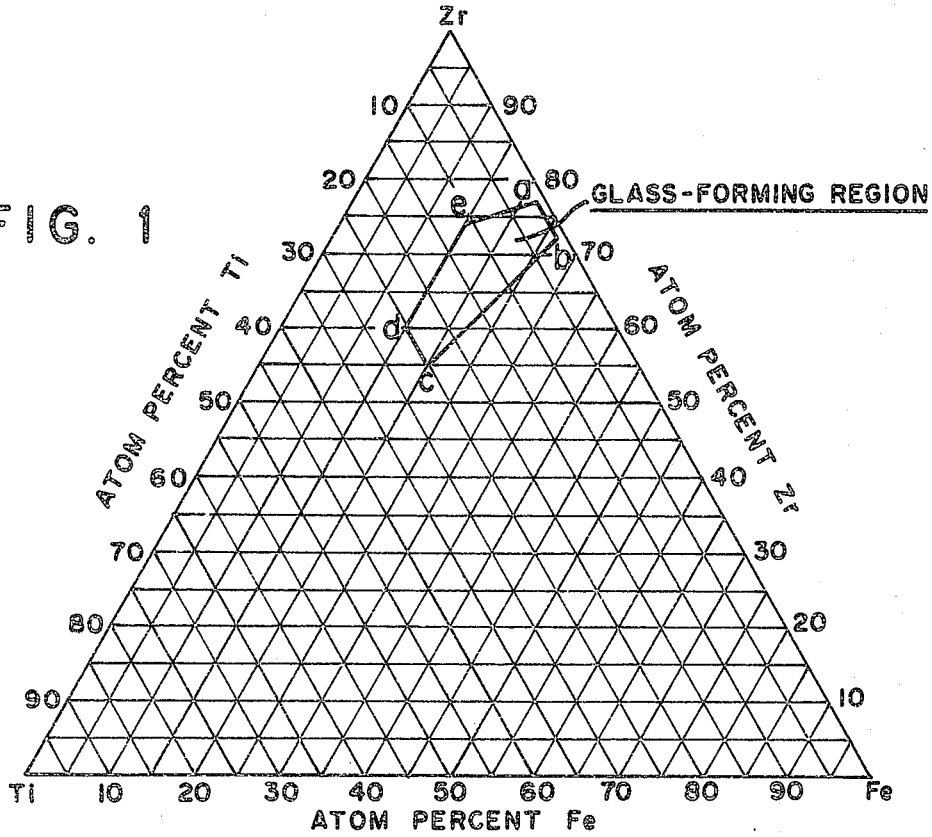
FIG. 1, on coordinates of atom percent, depicts the preferred glass-forming region in the zirconium-titanium-iron system.

In substantially totally glassy form, the alloys of the invention find use in a number of applications, especially including electrical applications, because of their uniquely high electrical resistivities of over 200 $\mu\Omega$-cm and negative or zero temperature coefficients of resistivity. These high electrical resistivities render such glassy alloys suitable for use in various applications such as elements for resistance thermometers, precision resistors and the like.

When formed in the crystalline state by well-known metallurgical methods, the compositions of the invention would be of little utility, since the crystalline compositions are observed to be hard, brittle and almost invariably multiphase, and cannot be formed or shaped. Consequently, these compositions cannot be rolled forged, etc. to form ribbon, wire, sheet and the like. On the other hand, such crystalline compositions may be used as precursor material for advantageously fabricating filaments of glassy alloys, employing well-known rapid quenching techniques. Such glassy alloys are substantially homogeneous, single phase and ductile. Further, such glassy alloys may be heat treated, if desired, to form a polycrystalline phase which remains ductile. The heat treatment is typically carried out at temperatures at or above that temperature at which devitrification occurs, called the crystallization temperature. The polycrystalline form permits stamping of complex piece parts from ribbon, foil and the like without the rapid degradation of stamping dies which otherwise occurs with the glassy phase.

As used herein, the term "filament" includes any slender body whose transverse dimensions are much smaller than its length, examples of which include ribbon, wire, strip, sheet and the like of regular or irregular cross-section.

The alloys of the invention consist essentially of about 1 to 64 atom percent titanium plus at least one element selected from the group consisting of about 15 to 27 atom percent iron, about 15 to 43 atom percent cobalt, about 15 to 42 atom percent nickel and about 35 to 68 atom percent copper, balance essentially zirconium plus incidental impurities, with the proviso that when iron is present, the maximum amount of titanium is about 25 atom percent, when cobalt is present, the maximum amount of titanium is about 54 atom percent and when nickel is present, the maximum amount of titanium is about 60 atom percent.

In weight percent, the composition ranges of the alloys of the invention may be expressed as follows:

| | | | |
|---|---|---|---|
| Ti 0.6–16 | Ti 0.6–41 | Ti 0.6–53 | Ti 0.6–57 |
| Fe 19–10 | Co 33–12 | Ni 38–12 | Cu 72–27 |
| Zr bal. | Zr bal. | Zr bal. | Zr bal. |

The purity of all compositions is that commonly found in normal commercial practice. However, addition of minor amounts of other elements that do not appreciably alter the basic character of the alloys may also be made.

Preferably, the alloys of the invention are primarily glassy, but may include a minor amount of crystalline material. However, since an increasing degree of glassiness results in an increasing degree of ductility, together with exceptionally high electrical resistivity values, it is most preferred that the alloys of the invention be substantially totally glassy.

The term "glassy", as used herein, means a state of matter in which the component atoms are arranged in a disorderly array; that is, there is no long range order. Such a glassy material gives rise to broad, diffuse diffraction peaks when subjected to electromagnetic radiation in the X-ray region (about 0.01 to 50 Å wavelength). This is in contrast to crystalline material, in which the component atoms are arranged in an orderly array, giving rise to sharp diffraction peaks.

The thermal stability of a glassy alloy is an important property in certain applications. Thermal stability is characterized by the time-temperature transformation behavior of an alloy, and may be determined in part by DTA (differential thermal analysis). Glassy alloys with similar crystallization behavior as observed by DTA may exhibit different embrittlement behavior upon exposure to the same heat treatment cycle. By DTA measurement, crystallization temperatures $T_c$ can be accurately determined by heating a glassy alloy (at about 20° to 50° C./min) and noting whether excess heat is evolved over a limited temperature range (crystallization temperature) or whether excess heat is absorbed over a particular temperature range (glass transition temperature). In general, the glass transition temperature is near the lowest, or first, crystallization temperature $T_{cl}$ and, as is conventional, is the temperature at which the viscosity ranges from about $10^{13}$ to $10^{14}$ poise.

The glassy alloys of the invention are formed by cooling a melt of the desired composition at a rate of at least about $10^{5}$° C./sec. A variety of techniques are available, as is well-known in the art, for fabricating splat-quenched foils and rapid-quenched substantially continuous filaments. Typically, a particular composition is selected, powders or granules of the requisite elements in the desired proportions are melted and homogenized, and the molten alloy is rapidly quenched on a chill surface, such as a rapidly rotating cylinder. Alternatively, polycrystalline alloys of the desired composition may be employed as precursor material. Due to the highly reactive nature of these compositions, it is preferred that the alloys be fabricated in an inert atmosphere or in a partial vacuum.

While splat-quenched foils are useful in limited applications, commercial applications typically require homogeneous, ductile materials. Rapidly-quenched filaments are substantially homogeneous, single phase and ductile and evidence substantially uniform thickness, width, composition and degree of glassiness and are accordingly preferred.

Preferred alloys of the invention and their glass-forming ranges are as follows:

Zirconium-Titanium-Iron System

Compositions of the invention in the zirconium-titanium-iron system consist essentially of about 1 to 25 atom percent (about 0.6–16 wt%) titanium, about 27 to 15 atom percent (about 19–10 wt%) iron and the balance essentially zirconium plus incidental impurities. Substantially totally glassy compositions are obtained in the region shown in FIG. 1 bounded by the polygon a-b-c-d-e-a having at its corners the points defined by (a) 77 Zr - 1 Ti - 22 Fe
(b) 72 Zr - 1 Ti - 27 Fe
(c) 55 Zr - 25 Ti - 20 Fe
(d) 60 Zr - 25 Ti - 15 Fe
(e) 74 Zr - 11 Ti - 15 Fe.

Zirconium-Titanium-Cobalt System

Figure 2:
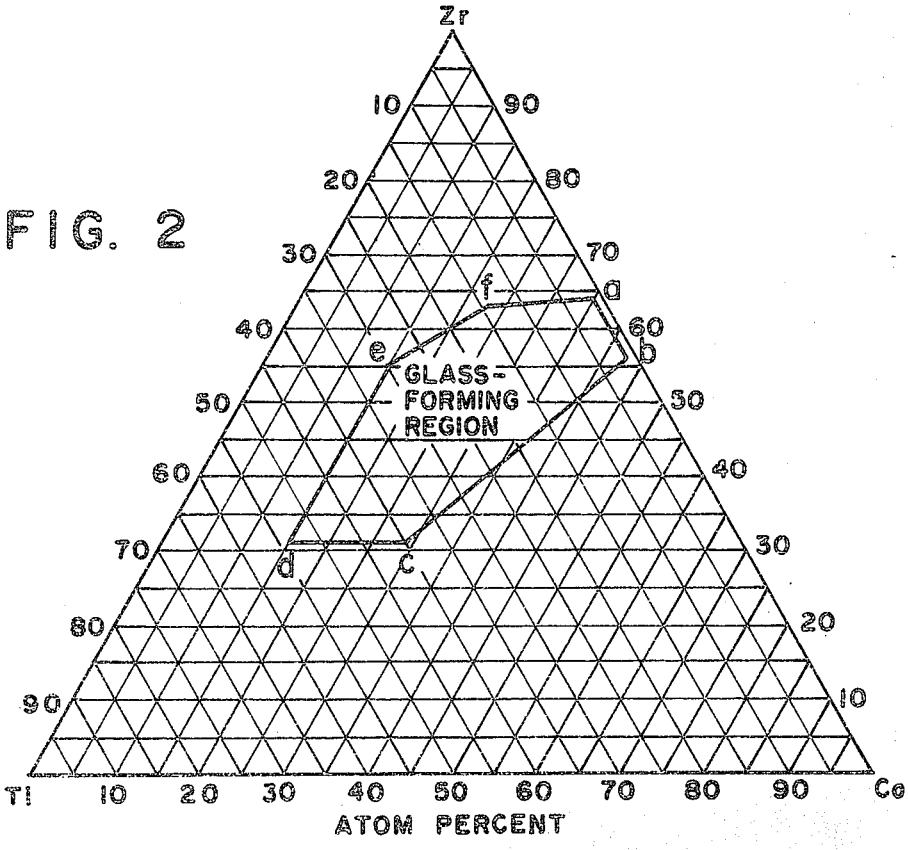
FIG. 2, on coordinates of atom percent, depicts the preferred glass-forming region in the zirconium-titanium-cobalt system.

Compositions of the invention in the zirconium-titanium-cobalt system consist essentially of about 1 to 54 atom percent (about 0.6–41 wt%) titanium, about 43 to 15 atom percent (about 33–12 wt%) cobalt and the balance essentially zirconium plus incidental impurities. Substantially totally glassy compositions are obtained in the region shown in FIG. 2 bounded by the polygon a-b-c-d-e-f-a having at its corners the points defined by (a) 64 Zr - 1 Ti - 35 Co
(b) 56 Zr - 1 Ti - 43 Co
(c) 31 Zr - 40 Ti - 29 Co
(d) 31 Zr - 54 Ti - 15 Co
(e) 55 Zr - 30 Ti - 15 Co
(f) 63 Zr - 14 Ti - 23 Co.

Zirconium-Titanium-Nickel System

Figure 3:
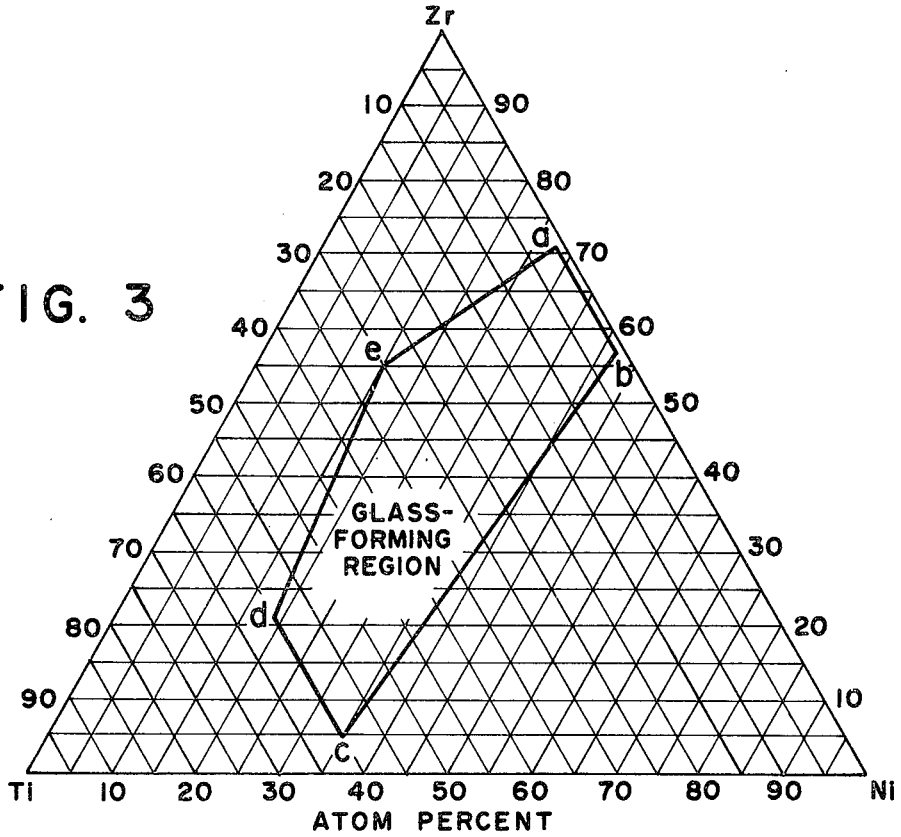
FIG. 3, on coordinates of atom percent, depicts the preferred glass-forming region in the zirconium-titanium-nickel system.

Compositions of the invention in the zirconium-titanium-nickel system consist essentially of about 1 to 60 atom percent (about 0.6–53 wt%) titanium, about 42 to 15 atom percent (about 38–12 wt%) nickel and the balance essentially zirconium plus incidental impurities. Substantially totally glassy compositions are obtained in the region shown in FIG. 3 bounded by the polygon a-b-c-d-e-a having at its corners the points defined by (a) 71 Zr - 1 Ti - 28 Ni
(b) 57 Zr - 1 Ti - 42 Ni
(c) 5 Zr - 60 Ti - 35 Ni
(d) 21 Zr - 60 Ti - 19 Ni
(e) 55 Zr - 30 Ti - 15 Ni.

Zirconium-Titanium-Copper System

Figure 4:
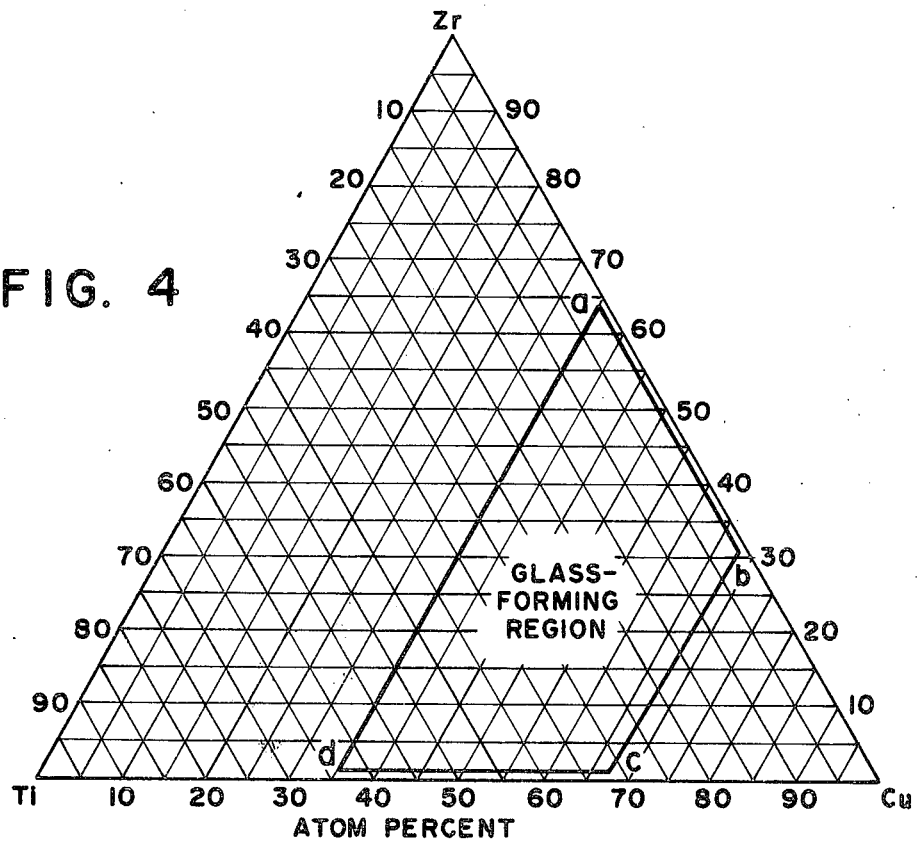
FIG. 4, on coordinates of atom percent, depicts the preferred glass-forming region in the zirconium-titanium-copper system.

Compositions of the invention in the zirconium-titanium-copper system consist essentially of about 1 to 64 atom percent (about 0.6–57 wt%) titanium, about 68 to 35 atom percent (about 72–27 wt%) copper and the balance essentially zirconium plus incidental impurities. Substantially totally glassy compositions are obtained in the region shown in FIG. 4 bounded by the polygon a-b-c-d-a having at its corners the points defined by (a) 64 Zr - 1 Ti - 35 Cu
(b) 31 Zr - 1 Ti - 68 Cu
(c) 1 Zr - 32 Ti - 67 Cu
(d) 1 Zr - 64 Ti - 35 Cu.

EXAMPLES

Example 1

Continuous ribbons of several compositions of glassy alloys of the invention were fabricated in vacuum employing quartz crucibles and extruding molten material onto a rapidly rotating copper chill wheel (surface speed about 3000 to 6000 ft/min) by over-pressure of argon. A partial pressure of about 200 μm of Hg was employed. A cooling rate of at least about $10^{5}$° C./sec was attained. The degree of glassiness was determined by X-ray diffraction. From this, the limit of the glass-forming region in each system were established.

In addition, a number of physical properties of specific compositions were measured. Hardness was measured by the diamond pyramid technique, using a Vickers-type indenter consisting of a diamond in the form of a square-base pyramid with an included angle of 136° between opposite faces. Loads of 100 g were applied. Crystallization temperature was measured by differential thermal analysis at a scan rate of about 20° C./min. Electrical resistivity was measured at room temperature by a conventional four-probe method.

The following values of hardness in kg/mm$^2$, density in g/cm$^3$, crystallization temperature in ° K. and electrical resistivity in $\mu\Omega$-cm, listed in Table I below, were measured for a number of compositions within the scope of the invention.

TABLE I

| Composition (atom percent) | Hardness (kg/mm$^2$) | Density (g/cm$^3$) | Crystallization Temp. (° K.) | Electrical Resistivity ($\mu\Omega$-cm) |
|---|---|---|---|---|
| $Zr_{60}Ti_{20}Fe_{20}$ | 492 | 6.40 | 645 | 256 |
| $Zr_{55}Ti_{20}Co_{25}$ | 473 | 6.56 | 655 | 286 |
| $Zr_{35}Ti_{30}Ni_{35}$ | 569 | 6.52 | 790 | 277 |
| $Zr_{35}Ti_{20}Cu_{45}$ | 623 | 6.87 | 712 | 326 |

EXAMPLE 2

Continuous ribbons of several compositions of glassy alloys in the zirconium-titanium-iron system were fabricated as in Example 1. Hardness values in kg/mm$^2$ (50 g load) and density in g/cm$^3$ are listed in Table II.

TABLE II

| Composition (atom percent) | | | Hardness | Density |
|---|---|---|---|---|
| Zr | Ti | Fe | (kg/mm$^2$) | (g/cm$^3$) |
| 75 | 5 | 20 | 460 | 6.64 |
| 70 | 5 | 25 | 475 | 6.78 |
| 65 | 10 | 25 | 496 | 6.84 |
| 55 | 20 | 25 | — | 6.54 |

EXAMPLE 3

Continuous ribbons of several compositions of glassy alloys in the zirconium-titanium-cobalt system were fabricated as in Example 1. Hardness values in kg/mm$^2$ (50 g load) and density in g/cm$^3$ are listed in Table III.

TABLE III

| Composition (atom percent) | | | Hardness | Density |
|---|---|---|---|---|
| Zr | Ti | Co | (kg/mm$^2$) | (g/cm$^3$) |
| 80 | 5 | 15 | 549 | 6.70 |
| 70 | 5 | 25 | 437 | 6.94 |
| 60 | 5 | 35 | 494 | 7.07 |
| 55 | 5 | 40 | — | 7.22 |
| 70 | 10 | 20 | 429 | 6.68 |
| 65 | 10 | 25 | 460 | 6.76 |
| 60 | 10 | 30 | 441 | 6.89 |
| 55 | 10 | 35 | 480 | 6.96 |
| 50 | 10 | 40 | — | 7.17 |
| 70 | 15 | 15 | — | 6.58 |
| 60 | 20 | 20 | 401 | 6.56 |
| 50 | 20 | 30 | 471 | 6.68 |
| 45 | 20 | 35 | 527 | 6.75 |
| 40 | 20 | 40 | 575 | 6.92 |
| 55 | 30 | 15 | — | 6.22 |
| 50 | 30 | 20 | 449 | 6.33 |

TABLE III-continued

| Composition (atom percent) | | | Hardness | Density |
|---|---|---|---|---|
| Zr | Ti | Co | (kg/mm$^2$) | (g/cm$^3$) |
| 45 | 30 | 25 | 475 | 6.39 |
| 40 | 30 | 30 | 527 | 6.56 |
| 35 | 30 | 35 | 581 | 6.59 |
| 30 | 30 | 40 | 613 | 6.73 |
| 35 | 35 | 30 | 539 | 6.42 |
| 40 | 40 | 20 | — | 6.16 |
| 35 | 40 | 25 | 506 | 6.23 |
| 25 | 40 | 35 | — | 6.38 |
| 30 | 45 | 25 | 557 | 6.11 |
| 35 | 50 | 15 | — | 5.92 |
| 25 | 50 | 25 | 532 | 6.04 |

EXAMPLE 4

Continuous ribbons of several compositions of glassy alloys in the zirconium-titanium-nickel system were fabricated as in Example 1. Hardness values in kg/mm$^2$ (50 g load) and density in g/cm$^3$ are listed in Table IV.

TABLE IV

| Composition (atom percent) | | | Hardness | Density |
|---|---|---|---|---|
| Zr | Ti | Ni | (kg/mm$^2$) | (g/cm$^3$) |
| 60 | 5 | 35 | 512 | 7.03 |
| 55 | 5 | 40 | 593 | 7.18 |
| 70 | 10 | 20 | 401 | 6.67 |
| 60 | 10 | 30 | 540 | 6.83 |
| 55 | 10 | 35 | 529 | 6.94 |
| 50 | 10 | 40 | 530 | 7.04 |
| 60 | 20 | 20 | 438 | 6.48 |
| 50 | 20 | 30 | 513 | 6.70 |
| 40 | 20 | 40 | 584 | 6.83 |
| 45 | 25 | 30 | 540 | 6.87 |
| 45 | 30 | 25 | 483 | 6.39 |
| 25 | 35 | 40 | 815 | 6.88 |
| 25 | 40 | 35 | 593 | 6.35 |
| 15 | 45 | 40 | 655 | 6.33 |
| 17.5 | 47.5 | 35 | 637 | 6.18 |
| 10 | 55 | 35 | 701 | 5.96 |
| 5 | 55 | 40 | 726 | 6.12 |
| 5 | 60 | 35 | 633 | 5.91 |

EXAMPLE 5

Continuous ribbons of several compositions of glassy alloys in the zirconium-titanium-copper system were fabricated as in Example 1. Hardness values in kg/mm$^2$ and density in g/cm$^3$ are listed in Table V below.

TABLE V

| Composition (atom percent) | | | Hardness | Density |
|---|---|---|---|---|
| Zr | Ti | Cu | (kg/mm$^2$) | (g/cm$^3$) |
| 60 | 5 | 35 | 52 | 6.94 |
| 55 | 5 | 40 | 626 | 7.10 |
| 30 | 5 | 65 | 655 | 7.71 |
| 40 | 10 | 50 | 557; 670 | 7.29; 7.24 |
| 30 | 10 | 60 | 666; 743 | 7.54 |
| 25 | 10 | 65 | 726; 693 | 7.64; 7.49 |
| 45 | 15 | 40 | 549 | 6.92 |
| 30 | 15 | 55 | 719 | 7.30 |
| 25 | 15 | 60 | 603 | 7.43 |
| 15 | 20 | 65 | 681 | 7.34 |
| 40 | 25 | 35 | 560; 524 | 6.59; 6.65 |
| 25 | 25 | 50 | 613 | 6.86 |
| 30 | 30 | 40 | 566 | 6.69 |
| 15 | 30 | 55 | 590 | 7.02 |
| 10 | 30 | 60 | 704; 673 | 7.07; 7.05 |
| 5 | 30 | 65 | 651 | 7.14 |
| 20 | 35 | 45 | 581; 603 | 6.60; 6.59 |
| 25 | 40 | 35 | 546 | 6.34 |
| 10 | 40 | 50 | 673; 640 | 6.57; 6.53 |

TABLE V-continued

| Composition (atom percent) | | | Hardness | Density |
|---|---|---|---|---|
| Zr | Ti | Cu | (kg/mm$^2$) | (g/cm$^3$) |
| 15 | 50 | 35 | 557 | 6.04 |
| 10 | 50 | 40 | 620; 584 | 6.19; 6.18 |
| 5 | 60 | 35 | 549 | 5.87 |

What is claimed is:

1. A process for preparing a zirconium-base alloy comprising the steps of:

a. cooling a melt of alloy consisting essentially of a composition selected from the group consisting of (i) zirconium, titanium and iron which, when plotted on a ternary composition diagram in atom percent Zr, atom percent Ti and atom percent Fe, is represented by a polygon having at its corners the points defined by (1) 77 Zr - 1 Ti - 22 Fe
(2) 72 Zr - 1 Ti - 27 Fe
(3) 55 Zr - 25 Ti - 20 Fe
(4) 60 Zr - 25 Ti - 15 Fe
(5) 74 Zr - 11 Ti - 15 Fe;

(ii) zirconium, titanium and cobalt which, when plotted on a ternary composition diagram in atom percent Zr, atom percent Ti and atom percent Co, is represented by a polygon having at its corners the points defined by (1) 64 Zr - 1 Ti - 35 Co
(2) 56 Zr - 1 Ti - 43 Co
(3) 31 Zr - 40 Ti - 29 Co
(4) 31 Zr - 54 Ti - 15 Co
(5) 55 Zr - 30 Ti - 15 Co
(6) 63 Zr - 14 Ti - 23 Co;

(iii) zirconium, titanium and nickel which, when plotted on a ternary composition diagram in atom percent Zr, atom percent Ti and atom percent Ni, is represented by a polygon having at its corners the points defined by (1) 71 Zr - 1 Ti - 28 Ni
(2) 57 Zr - 1 Ti - 42 Ni
(3) 5 Zr - 60 Ti - 35 Ni
(4) 21 Zr - 60 Ti - 19 Ni
(5) 55 Zr - 30 Ti - 15 Ni; and (iv) zirconium, titanium and copper which, when plotted on a ternary composition diagram in atom percent Zr, atom percent Ti and atom percent Cu, is represented by a polygon having at its corners the points defined by (1) 64 Zr - 1 Ti - 35 Cu
(2) 31 Zr - 1 Ti - 68 Cu
(3) 1 Zr - 32 Ti - 67 Cu
(4) 1 Zr - 64 Ti - 35 Cu, said cooling step being conducted at a cooling rate of at least about 105° C./sec to thereby produce a substantially glassy phase of said alloy; and b. heating said substantially glassy alloy at a temperature at or above its crystallization temperature to cause said alloy to form a polycrystalline phase.

2. A process as recited in claim 1, wherein each of said cooling and heating steps is conducted in an inert atmosphere.

3. A process as recited in claim 1, wherein each of said cooling and heating steps is conducted in a partial vacuum.

* * * * *